US008113930B1

(12) United States Patent
Coats

(10) Patent No.: US 8,113,930 B1
(45) Date of Patent: Feb. 14, 2012

(54) DARTBOARD ASSEMBLY

(76) Inventor: John O. Coats, Harrisburg, PA (US)

( * ) Notice: Subject to any disclaimer, the term of this patent is extended or adjusted under 35 U.S.C. 154(b) by 431 days.

(21) Appl. No.: 12/372,804

(22) Filed: Feb. 18, 2009

(51) Int. Cl.
*A63F 9/24* (2006.01)

(52) U.S. Cl. ..... 463/5; 273/333; 273/348

(58) Field of Classification Search ..... 463/5
See application file for complete search history.

(56) References Cited

U.S. PATENT DOCUMENTS

| | | | | |
|---|---|---|---|---|
| 5,553,859 | A * | 9/1996 | Kelly et al. | 273/338 |
| 5,956,485 | A | 9/1999 | Perlman | |
| 5,984,787 | A | 11/1999 | Redpath | |
| D423,597 | S | 4/2000 | Martin et al. | |
| 6,089,571 | A | 7/2000 | Cho | |
| 6,817,947 | B2 | 11/2004 | Tanskanen | |
| 7,285,049 | B1 | 10/2007 | Luciano, Jr. et al. | |
| 2004/0106449 | A1 * | 6/2004 | Walker et al. | 463/25 |
| 2005/0075153 | A1 * | 4/2005 | Valero Moreno | 463/1 |
| 2006/0066053 | A1 * | 3/2006 | Skala | 273/348 |
| 2008/0085770 | A1 | 4/2008 | Morgan | |

OTHER PUBLICATIONS

Gaelco, Radikal Darts Operators Manual Model PF-25, 2004, pp. 1-20, 31-40, 50-75.*

* cited by examiner

*Primary Examiner* — Melba Bumgarner
*Assistant Examiner* — Tramar Harper

(57) ABSTRACT

A dartboard assembly includes a housing that has a front wall, a rear wall and a perimeter wall attached to and extending between the front and rear walls. A dartboard is mounted on the front wall. A support apparatus is attached to the housing. A game camera is mounted on the support apparatus and is directed toward the dartboard when the support apparatus is in a deployed position. A player camera is mounted to the support apparatus and is directed away from the dartboard and toward any player throwing darts at the dartboard. A data port is mounted on the housing and is electrically coupled to each of the game and player cameras. The data port is connectable to a computer network to allow other persons to remotely view the game and player cameras.

4 Claims, 4 Drawing Sheets

DARTBOARD ASSEMBLY

BACKGROUND OF THE DISCLOSURE

Field of the Disclosure

The disclosure relates to dartboard devices and more particularly pertains to a new dartboard device for allowing players to play darts against each other over a computer network system such as the Internet.

SUMMARY OF THE DISCLOSURE

An embodiment of the disclosure meets the needs presented above by generally comprising a housing that has a front wall, a rear wall and a perimeter wall attached to and extending between the front and rear walls. A dartboard is mounted on the front wall. A support apparatus is attached to the housing. A game camera is mounted on the support apparatus and is directed toward the dartboard when the support apparatus is in a deployed position. A player camera is mounted to the support apparatus and is directed away from the dartboard and toward any player throwing darts at the dartboard. A data port is mounted on the housing and is electrically coupled to each of the game and player cameras. The data port is connectable to a computer network to allow other persons to remotely view the game and player cameras.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
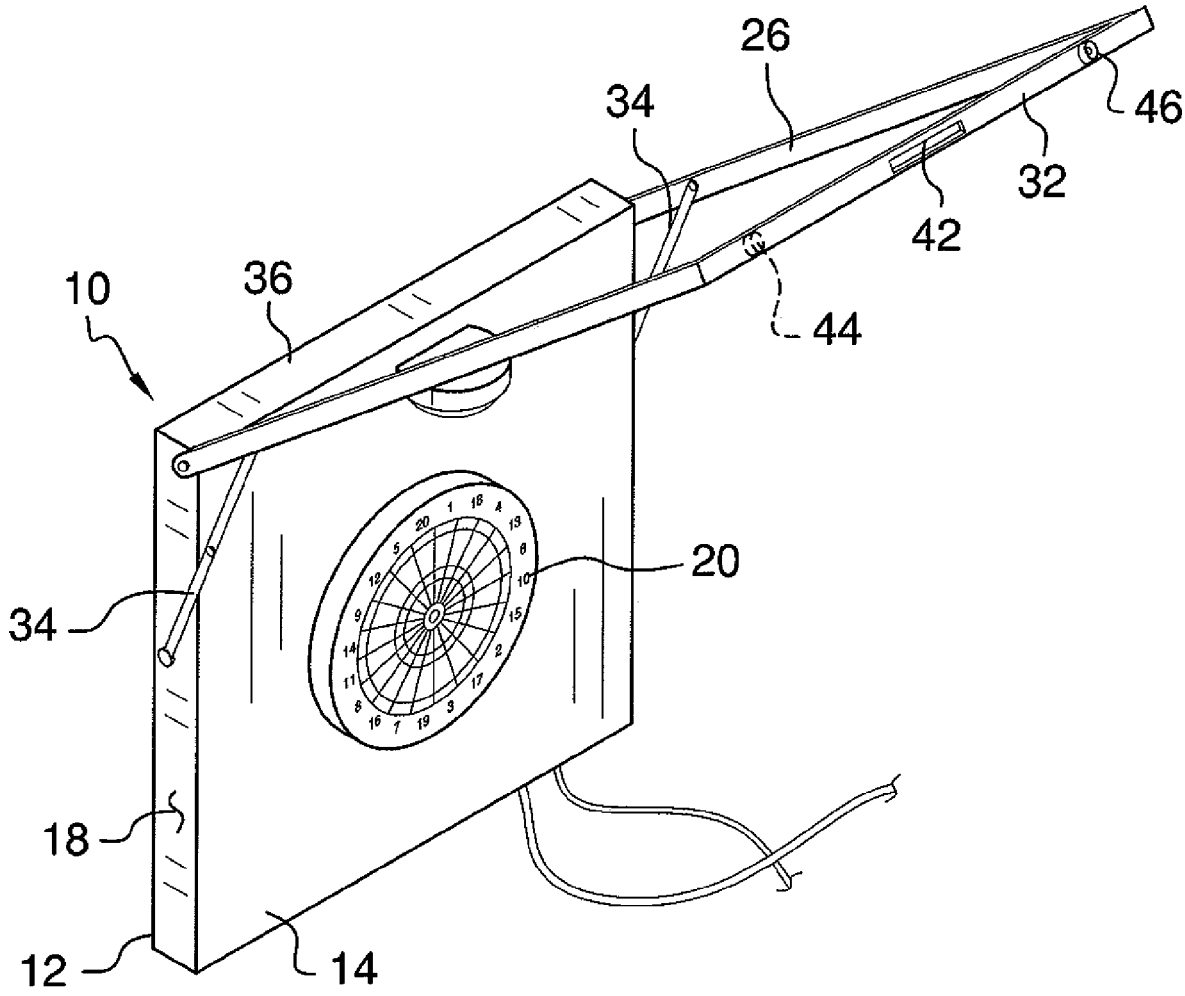
FIG. 1 is a front perspective view of a dartboard assembly according to an embodiment of the disclosure in a deployed position.
Figure 2:
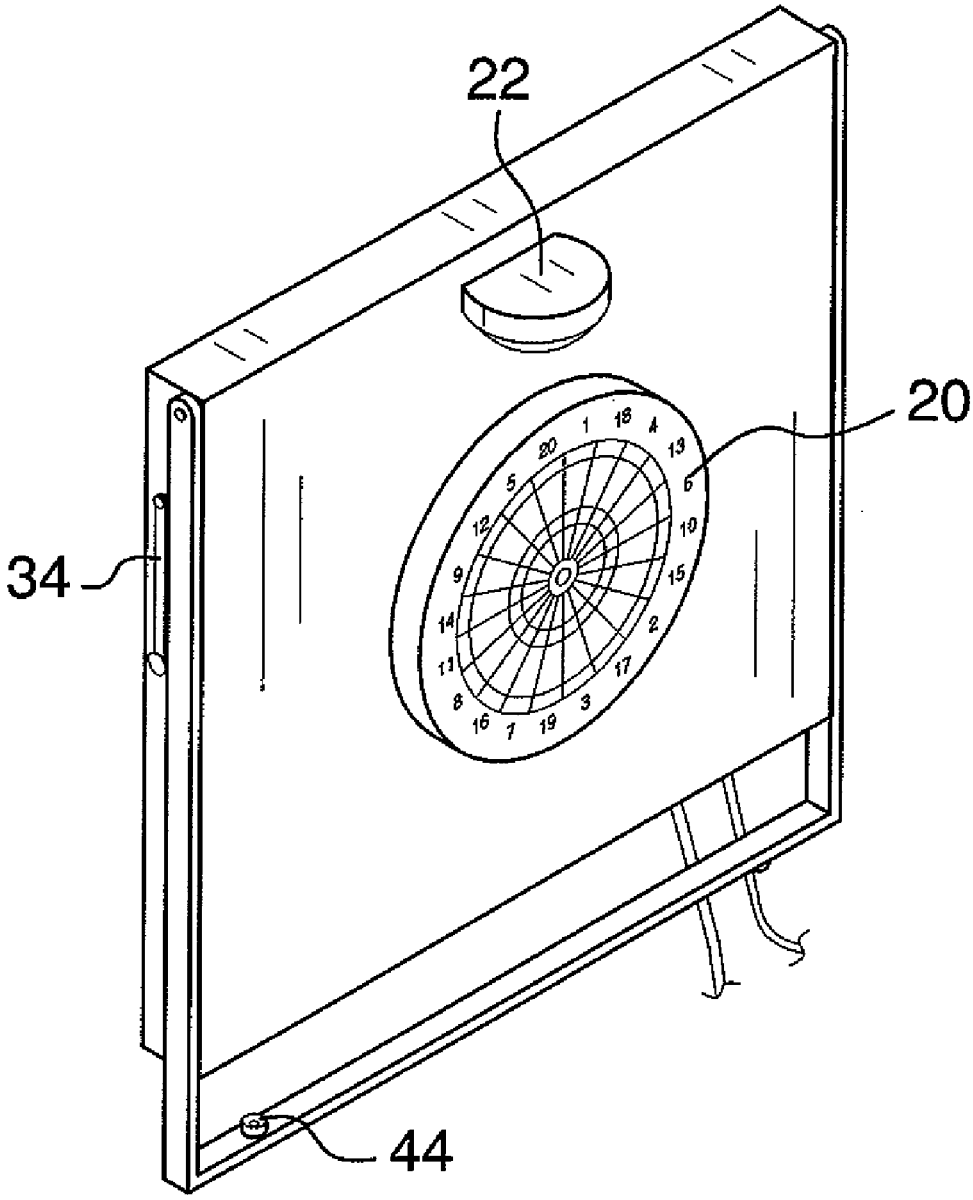
FIG. 2 is a front view of an embodiment of the disclosure in a stored position.
Figure 3:
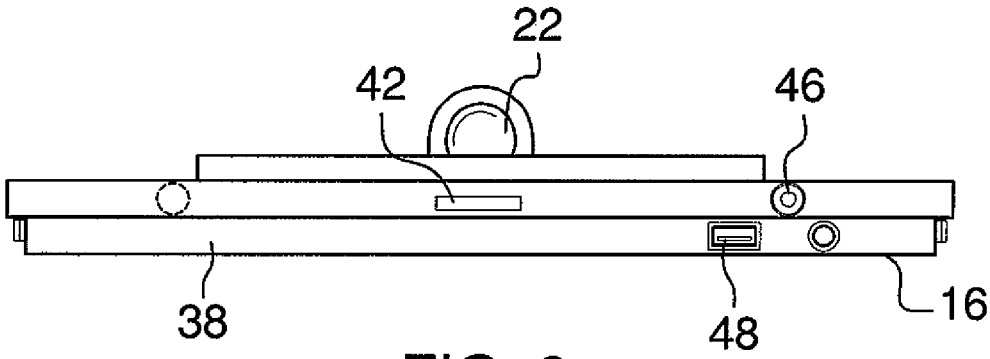
FIG. 3 is a bottom view of an embodiment of the disclosure.
Figure 4:
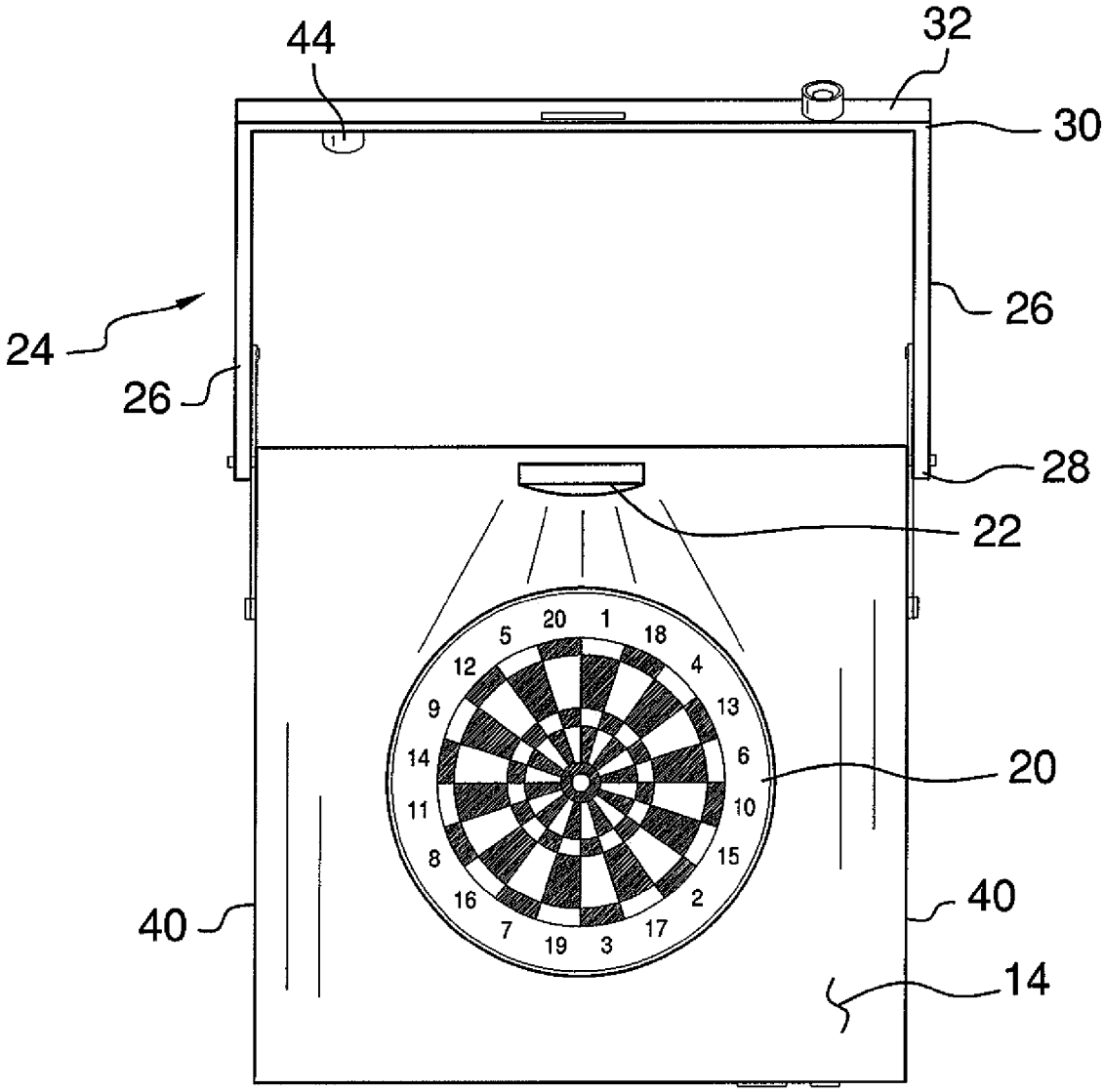
FIG. 4 is a front view of an embodiment of the disclosure.
Figure 5:
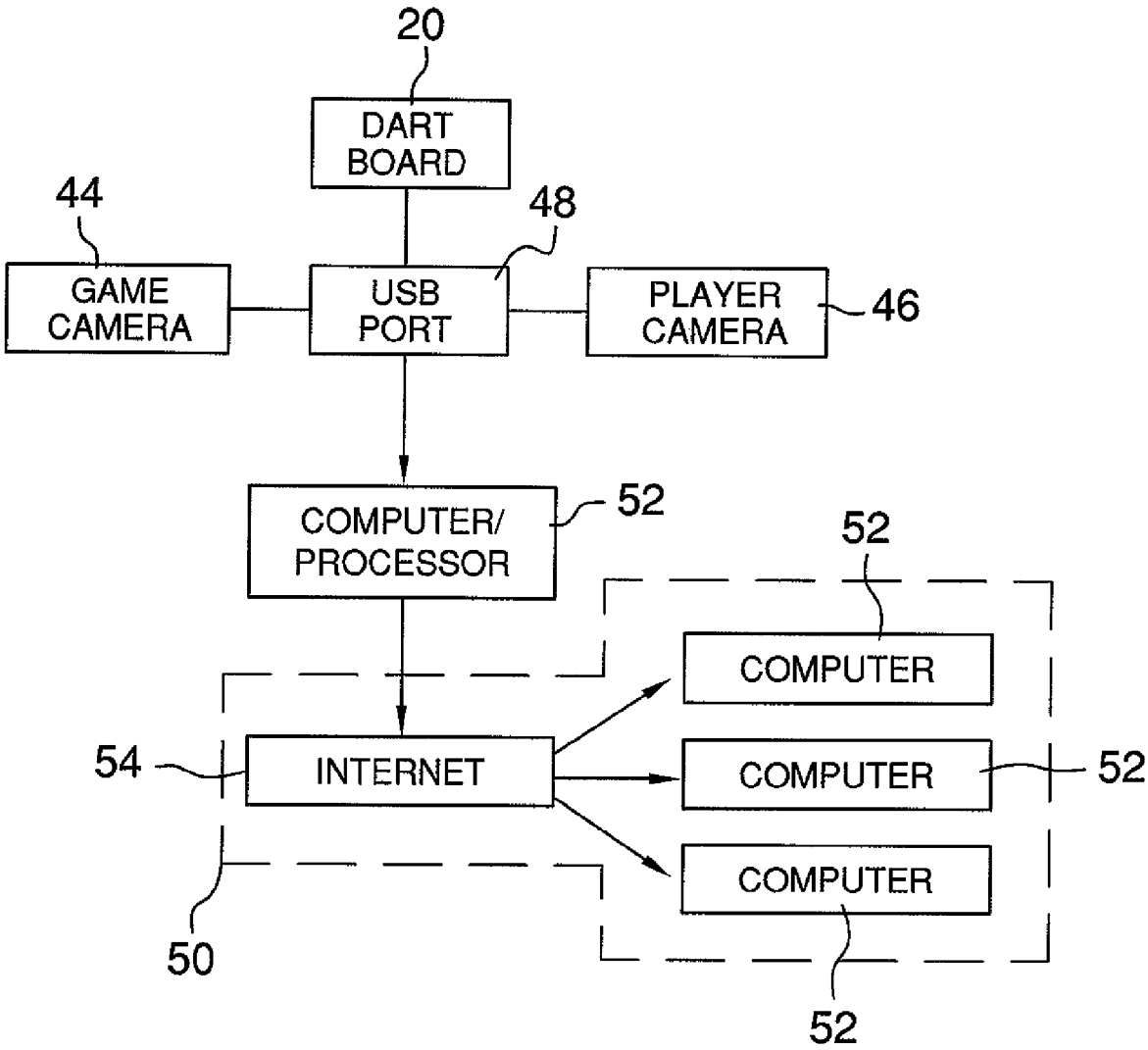
FIG. 5 is a schematic view of an embodiment of the disclosure.

With reference now to the drawings, and in particular to FIGS. 1 through 5 thereof, a new dartboard device embodying the principles and concepts of an embodiment of the disclosure and generally designated by the reference numeral 10 will be described.

As best illustrated in FIGS. 1 through 5, the dartboard assembly 10 generally comprises a housing 12 that has a front wall 14, a rear wall 16 and a perimeter wall 18 is attached to and extends between the front 14 and rear 16 walls. A dartboard 20 is mounted on the front wall 14. The dartboard 20 may either be a conventional, passive type dartboard or may comprise an electronic dartboard capable of tracking player turns and scores. A light emitter 22 is mounted on the housing 12 and is directed toward the dartboard to illuminate the dartboard.

A support apparatus 24 is attached to the housing 12 and is extendable outwardly away from the front wall 14. The support apparatus 24 includes a pair of arms 26 that each has a first end 28 and a second end 30. The first end 28 of each of the arms 26 is pivotally attached to perimeter wall 18 and the arms 26 are positioned on opposite sides of the housing with respect to each other. A central member 32 is attached to and extends between the second ends 30 of the arms 26. The support apparatus 24 is positionable in a stored position folded against the housing 12 or in a deployed position extending outwardly from the housing 12. A support rod 34 is attached to the housing 12 and one of the arms 26 to releasably retain the support apparatus 24 in the deployed position. When in the deployed position, an angle between the arms 26 and the front wall 14 is between 100° and 135° to prevent the central member 32 from being struck by darts. The perimeter wall 18 includes a top wall 36, a bottom wall 38 and a pair of lateral walls 40. The first ends 28 of the arms 26 are positioned adjacent to the top wall 36. The central member 32 includes a finger grip notch 42 therein to assist a person rotating the support apparatus 24 with respect to the housing 12.

A game camera 44 is mounted on the support apparatus 24, and more particularly is mounted on the central member 32. The game camera 44 is directed toward the dartboard 20 when the support apparatus 24 is in the deployed position. A player camera 46 is mounted to the support apparatus 24 and more particularly is also mounted on the central member 32. The player camera 46 is directed away from the dartboard 20 and toward any player throwing darts at the dartboard 20. The game 44 and player 46 cameras are conventional cameras typically known as "web cams" and function in a like manner.

A data port 48 is mounted on the housing 12 and is electrically coupled to each of the game 44 and player 46 cameras. The data port 48 is connectable to a computer network 50 to allow other persons to remotely view the game 44 and player 46 cameras and in this manner may comprise any conventional data port, such a USB port. If the dartboard 20 is an electronic dartboard, the USB port will also be electronically coupled to the dartboard 20. The computer network 50 would likely include computers 52 in communication with each other via the Internet 54. The computers 52 may be programmed to retain and or track scoring, particularly if the dartboards 20 are electronic so that the player turn and scoring inputs are retained or tracked by the computers 52 networked together.

In use, the dartboard 20 is used in a conventional manner to play any number of dart games. When a player wishes to remotely play another player, both players couple the data ports 48 from their location to local computers 52 so that the computers 52 can communicate through the Internet 54 to send video signals of the players and the dartboard 20 between the computers 52 for viewing by the other player. If the dartboards 20 are electronic, the scores achieved by the players will also be tracked by the computers 52. In this manner, players can play against each other regardless of their physical location with respect to each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A dartboard system comprising:

a housing having a front wall, a rear wall and a perimeter wall being attached to and extending between said front and rear walls;

a dartboard being mounted on said front wall;

a support apparatus being attached to said housing;

a game camera being mounted on said support apparatus, said game camera being directed toward said dartboard when said support apparatus is in a deployed position;

a player camera being mounted to said support apparatus, said player camera being directed away from said dartboard and toward any player throwing darts at said dartboard; and a data port being mounted on said housing and being electrically coupled to each of said game and player cameras, wherein said data port is connectable to a computer network to allow other persons to remotely view said game and player cameras;

said support apparatus including;

a pair of arms each having a first end and a second end, said first end of each of said arms being pivotally attached to perimeter wall and positioned on opposite sides of said housing with respect to each other; and a central member being attached to and extending between said second ends of said arms, said support apparatus being positionable in a stored position folded against said housing or in a deployed position extending outwardly from said housing.

2. The system according to claim 1, wherein said support apparatus further includes a support rod being attached to said housing and one of said arms to releasably retain said support apparatus in said deployed position.

3. The system according to claim 1, further including a light emitter being mounted on said housing and being directed toward said dartboard.

4. A dartboard system comprising:

a housing having a front wall, a rear wall and a perimeter wall being attached to and extending between said front and rear walls;

a dartboard being mounted on said front wall;

a support apparatus being attached to said housing and being extendable outwardly away from said front wall, said support apparatus including;

a pair of arms each having a first end and a second end, said first end of each of said arms being pivotally attached to perimeter wall and positioned on opposite sides of said housing with respect to each other;

a central member being attached to and extending between said second ends of said arms, said support apparatus being positionable in a stored position folded against said housing or in a deployed position extending outwardly from said housing;

a support rod being attached to said housing and one of said arms to releasably retain said support apparatus in said deployed position;

a game camera being mounted on said support apparatus, said game camera being directed toward said dartboard when said support apparatus is in said deployed position;

a player camera being mounted to said support apparatus, said player camera being directed away from said dartboard and toward any player throwing darts at said dartboard;

a data port being mounted on said housing and being electrically coupled to each of said game and player cameras, wherein said data port is connectable to a computer network to allow other persons to remotely view said game and player cameras; and a light emitter being mounted on said housing and being directed toward said dartboard.

* * * * *